US006682215B2

(12) United States Patent
Kinsley, Jr. et al.

(10) Patent No.: US 6,682,215 B2
(45) Date of Patent: Jan. 27, 2004

(54) PROCESS AND APPARATUS FOR MAKING SHEET OF FIBERS USING A FOAMED MEDIUM

(75) Inventors: Homan B. Kinsley, Jr., Powhatan, VA (US); Christopher B. Peart, Westhampton, MA (US)

(73) Assignee: Fibermark, Inc., Brattleboro, VT (US)

( * ) Notice: Subject to any disclaimer, the term of this patent is extended or adjusted under 35 U.S.C. 154(b) by 0 days.

(21) Appl. No.: 10/118,893

(22) Filed: Apr. 10, 2002

(65) Prior Publication Data

US 2003/0193836 A1 Oct. 16, 2003

(51) Int. Cl.[7] ..... B01F 7/18; D21H 27/00

(52) U.S. Cl. ..... 366/325.1; 366/307; 366/348; 162/101

(58) Field of Search ..... 366/307, 325.1, 366/101, 102, 279, 348; 162/101

(56) References Cited

U.S. PATENT DOCUMENTS

| | | | | | |
|---|---|---|---|---|---|
| 57,285 | A | * | 8/1866 | Burket et al. | 366/329.1 |
| 208,783 | A | * | 10/1878 | Baird | 366/102 |
| 900,547 | A | * | 10/1908 | James | 68/157 |
| 1,372,834 | A | * | 3/1921 | Schmelzer | 416/197 R |
| 2,011,483 | A | * | 8/1935 | Hansen | 366/102 |
| 2,384,952 | A | * | 9/1945 | Miller | 366/325.1 |
| 2,577,802 | A | * | 12/1951 | Payne | 366/325.1 |
| 2,727,439 | A | * | 12/1955 | Bolton et al. | 366/320 |
| 2,800,315 | A | * | 7/1957 | Griesbach | 261/87 |
| 2,966,345 | A | * | 12/1960 | Burgoon et al. | 366/102 |
| 3,716,449 | A | | 2/1973 | Gatward et al. | |
| 5,316,443 | A | * | 5/1994 | Smith | 366/330.1 |
| 5,472,278 | A | * | 12/1995 | Kawaoka et al. | 366/307 |
| 5,720,851 | A | | 2/1998 | Reiner | |

OTHER PUBLICATIONS

Search Report Issued in International Application No. PCT/US03/10638, Jul. 11, 2003, 2 pgs.

* cited by examiner

*Primary Examiner*—Tony G. Soohoo
(74) *Attorney, Agent, or Firm*—Burns, Doane, Swecker & Mathis, L.L.P.

(57) ABSTRACT

The present invention relates to an apparatus for effectively agitating non-cellulosic fibers in a foamed medium, comprising agitating means mounted for displacement within the foamed medium and including a leading surface facing in the direction of displacement. The leading surface includes upper and lower portions converging in the direction of displacement to form a generally convex leading surface and driving means for displacing the agitating means in the direction of displacement for dispersing and mutually separating the metal fibers within the foamed medium. The present invention further relates to a method for forming a non-woven fibrous web comprised of non-cellulosic fibers which comprises forming a foam furnish by agitating the fibers in a foamed medium with the aforedescribed apparatus, and passing the foam furnish onto a screen and defoaming the furnish.

34 Claims, 7 Drawing Sheets

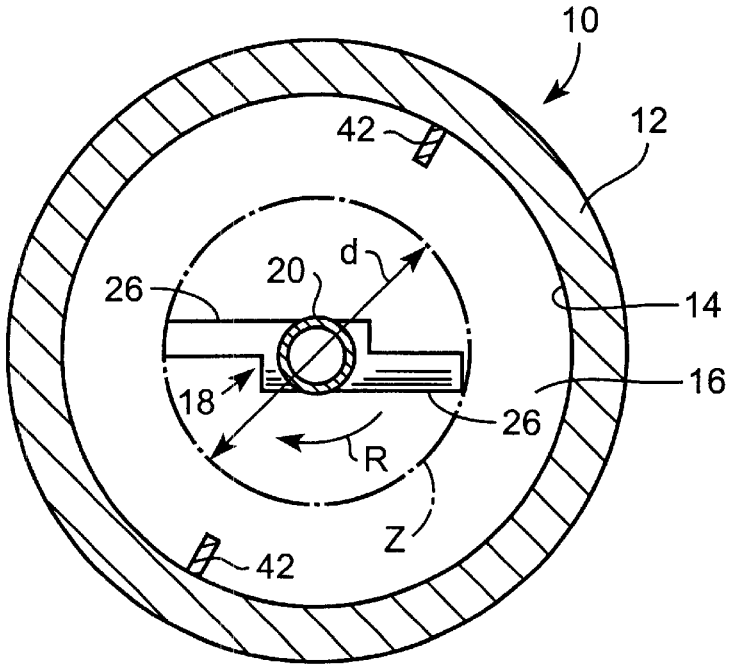
FIG. 2
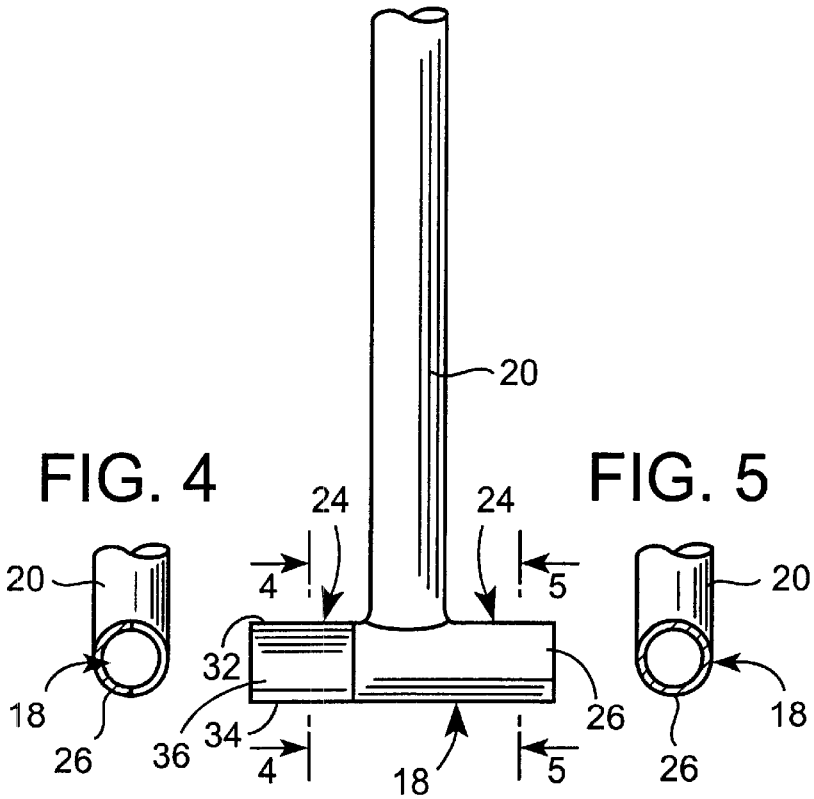
FIG. 4
FIG. 5
FIG. 3

PROCESS AND APPARATUS FOR MAKING SHEET OF FIBERS USING A FOAMED MEDIUM

BACKGROUND OF THE INVENTION

1. Field of the Invention

The present invention relates to a process for forming a sheet of fibers, particularly non-cellulosic fibers, using foam. The present invention also relates to a novel agitator for use in foam-forming a wet-laid, sheet of fibers. More specifically, the present invention relates to an efficient foam process for making a uniform sheet of fibers.

2. Description of the Related Art

The use of foam in a furnish for preparing wet-laid, non-woven fibrous webs is known. See, for example, U.S. Pat. No. 4,443,297, which discloses an apparatus and method for the manufacture of a non-woven fibrous web using foam. The method involves preparing a foam furnish with 55–75% volume air, recirculating a surfactant-water solution through a forming wire followed by foam storage in a silo to eliminate excess air, and then recycling foam from the bottom of the silo. See also, U.S. Pat. Nos. 4,349,414; 4,443,299; 4,498,956; 4,543,156; 5,720,851; 5,904,809; 6,238,518 and 6,258,203 as describing other methods of using a foam furnish for preparing wet-laid fibrous webs.

U.S. Pat. No. 4,488,932 relates to a method of manufacturing fibrous webs of enhanced bulk. The method involves hammermilling dry hydrophilic fibers to generate crimp, and then foam forming these fibers in 0.5 to 5 minutes to retain as much crimp as possible.

U.S. Pat. No. 4,686,006 relates to an apparatus and method for laying down a fibrous web from a foam-fiber furnish. A headbox is used which includes walls defining an elongate channel extending transversely of the direction of movement of the forming wire. Foam forming nozzles are positioned to introduce foam-fiber furnish into the channel for turbulence, inducing impact on an oppositely disposed wall defining the channel. The turbulently flowing foam-fiber furnish is then introduced to the headbox slice for discharge onto the forming wire with minimized orientation of the fibers.

Other patents which relate to the use of foam in making non-woven fibrous webs include U.S. Pat. Nos. 3,716,449; 3,938,782; 3,871,952; 3,837,999; 3,876,498; 3,846,232; 4,062,721; 3,746,613 and 4,056,456.

Sheets of metal fibers have been made using wet-laying techniques. However, the formed sheets lack uniformly and the processes are inefficient. Improved uniformity of dispersion and distribution of the metal fibers in the web would be a great step forward in the art, as would increased ease and efficiency in forming the web. Techniques useful in the formation of more uniform non-woven webs made of metal fibers would be of great benefit to the industry as such metal fiber sheets have many potential uses.

Furthermore, the use of conventional foam processes can still be improved, particularly in the manufacture of non-woven fibrous webs with long fibers, such as one-half inch or longer. Improved uniformity of dispersion and distribution of fibers in the web, particularly with long fibers, would be a great step forward in the art. Techniques useful in the formation of more uniform non-woven webs made of non-cellulosic fibers would be desirable and advantageous.

Accordingly, it is an object of the present invention to provide a novel process for forming a non-woven fibrous web of non-cellulosic fibers using foam, which process provides a web in which the fibers are uniformly and evenly distributed.

Yet another object of the present invention is to provide a novel agitator, which agitator is useful in preparing the foam furnish for forming a non-woven fibrous web of such fibers.

These and other objects and features of the invention will become apparent to one skilled in the art upon a review of the following description, the figures of the drawing and the claims.

SUMMARY OF THE INVENTION

In accordance with the foregoing objects, there is provided by the present invention an effective and efficient method for preparing a non-woven fibrous web of non-cellulosic fibers using a foam furnish, which foam furnish is prepared by using the novel agitating means of the present invention.

In one embodiment of the present invention, therefore, there is provided an apparatus for agitating non-cellulosic fibers in a foamed medium. The apparatus comprises agitating means mounted for displacement within a foamed medium and includes a leading surface facing in a direction of displacement, the leading surface including upper and lower portions converging in the direction of displacement to form a generally convex leading surface. The trailing surface is generally concave. The abrupt transition between the two surface shapes leads to cavitation or bubble formation. The apparatus further comprises driving means for displacing the agitating means in the direction of displacement for dispersing and mutually separating the fibers within the foamed medium.

In another embodiment of the present invention there is provided an apparatus for agitating fibers in a foamed medium, comprising a tank having a cylindrical surface forming an agitating chamber for containing a mixture of fibers and foamed medium, which can include other functional additives. The agitating means is mounted for rotation about an upright axis coinciding with a longitudinal axis of the agitating chamber and including a plurality of legs projecting generally radially from the axis, each leg including a leading surface facing in a direction of rotation and terminating in upper and lower trailing ends, said leading surface including upper and lower portions which converge in the direction of rotation to form a generally convex leading surface. The apparatus further comprises driving means for rotating the agitating means to disperse and mutually separate the metal fibers within the foamed medium, the agitating means forming a central agitation zone, the ratio of the diameter of the agitation zone to the diameter of the agitating chamber being from about 0.5 to about 0.95.

In another embodiment of the present invention there is provided a method for forming a non-woven, fibrous web composed of non-cellulosic fibers which comprises first forming a foam furnish by agitating the fibers in a foamed medium, preferably aqueous, with the agitating means of the present invention. The resulting foam furnish is then passed onto a screen and defoamed using conventional techniques.

In another embodiment of the present invention there is provided a non-woven fibrous web comprised of non-cellulosic fibers prepared by the method of the present invention. The web exhibits excellent uniformity, i.e., very few fiber bundles, and substantially no fiber directionality. The web can also comprise very long fibers, as the method of the present invention can easily, and with efficiency, handle long fibers.

BRIEF DESCRIPTION OF THE DRAWING

FIG. 2. is a top view of an agitating apparatus of the present invention.

FIGS. 3–5 are side and end views of the agitator.

DETAILED DESCRIPTION OF THE PREFERRED EMBODIMENTS

Figure 1:
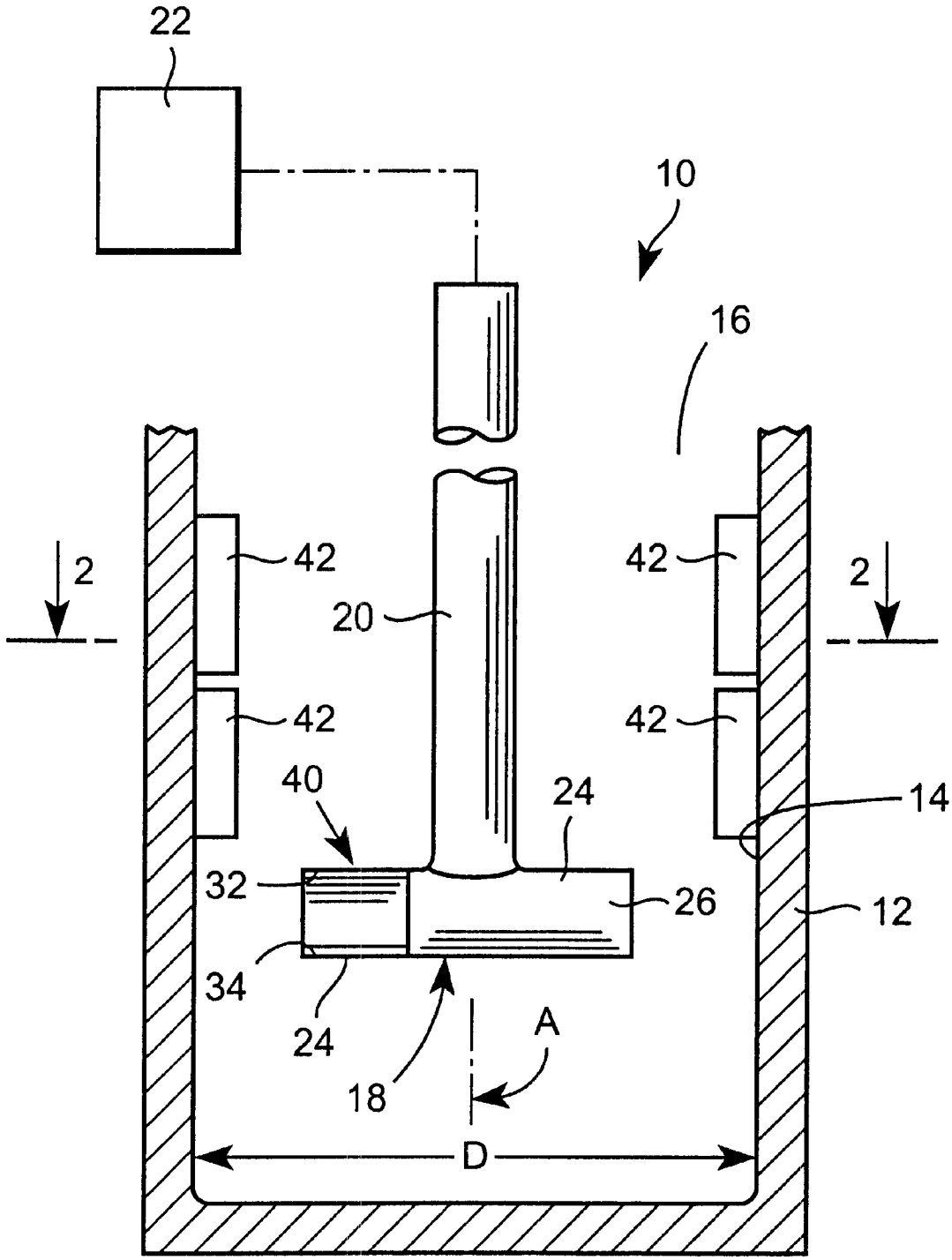
FIG. 1 is a side view of an agitating apparatus of the present invention.

The process of the present invention comprises the steps of first forming a foam furnish by agitating a fiber mixture comprised of up to 100% of non-cellulosic fibers, in a foamed medium with the agitation apparatus of the present invention, and then passing the foam furnish onto a screen, e.g., a wire or plastic fabricated screen, and defoaming the furnish. The agitating apparatus used in the process is depicted in the Figures of the Drawing, and can be described by reference thereto.

The agitating apparatus 10 shown in FIGS. 1–3 comprises a tank 12having an internal cylindrical surface 14 forming a cylindrical agitating chamber 16 which receives the mixture of fibers, surfactant, and water. The mixture is agitated by an agitator 18 which causes the surfactant and water to form a foamed medium in which the fibers are entrained. In particular, the agitator serves to keep the non-cellulosic fibers in a dispersed, mutually separated condition within the foamed medium, as will be hereinafter explained.

The agitator 18 is rotatable about a vertically upright axis A which coincides with the longitudinal axis of the cylindrical agitating chamber 16. The agitator is fixedly connected to the lower end of a vertical shaft 20 which is rotatably displaced by a motor 22 connected to an upper end of the shaft 20 in any suitable manner, such as by a pulley and belt connection represented by phantom lines.

Figure 12:
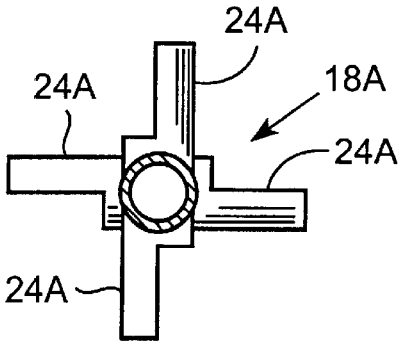
FIG. 12 is a top view of a four-legged agitator of the present invention.

The agitator 18 comprises a plurality of legs or blades 24 projecting radially from the axis A. The number of legs 24 may vary, there being two legs 24 shown in FIGS. 1 and 2. An alternative embodiment of the agitator 18A shown in FIG. 12 has four legs 24A. There could be other numbers of legs, e.g., three equally circumferentially spaced legs (not shown). The legs 24 shown in FIG. 1 are disposed in the same horizontal plane. Alternatively, the legs could be disposed in different planes. For example, if four legs 24A were used as shown in FIG. 12, they could be arranged in two pairs disposed in vertically spaced planes.

Figure 6:
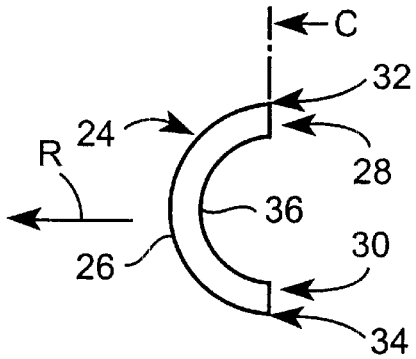
FIGS. 6–11 depict various acceptable shapes of the agitator legs.

Each leg includes a leading surface 26 facing in the direction of rotational displacement R (see FIGS. 2 and 6). That surface is of convex shape as the leg is viewed in cross section (see FIGS. 4 and 5). By convex is meant that the upper and lower portions of the leading surface converge in the direction of rotation R and meet at a relatively blunt junction. The bluntness of the junction precludes the collection of fibers. It is also preferred that the leading surface be smooth so that fibers can slip over its surface without forming flocs, spindles, or other forms of metal fiber or synthetic fiber aggregates.

Figure 11:
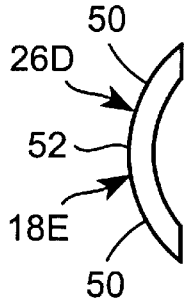

Various preferred convex configurations of the leading surface are depicted in FIGS. 6 and 11 and will be discussed hereinafter.

The leading surface 26 terminates in vertically spaced upper and lower trailing ends 28, 30 which form edges 32, 34, respectively. The trailing surface 36 of the leg 24, which surface faces away from the direction of rotation, is non-convex, e.g., concave in FIG. 6.

The legs 24 are formed by a hollow cylindrical bar 40. The axis A bisects the bar to form two bar sections disposed on opposite sides of the axis A. The portion of each bar section which faces away from the direction of rotation is truncated in that the trailing portion of the bar is cut along a plane C extending through the center of the bar (see FIG. 6). The truncation of a hollow cylinder represents a convenient way of forming the agitator, but, of course, other techniques could be used to form an agitator of the desired shape.

As the agitator rotates, it creates a circular agitation zone Z in the center of the agitation chamber or tank 16 (see FIG. 2). The ratio of the diameter of that agitation zone to the diameter of the agitation chamber 16 (i.e., d/D) is preferably from about 0.5 to about 0.95, more preferably from about 0.65 to about 0.80; and most preferably from about 0.67 to about 0.75.

Rotation of the agitator 18 is initiated after the mixture of non-cellulosic fibers, water, and surfactant is placed within the agitation chamber Other functional additives can be added, if desired. In response to that rotation, the surfactant and water produce a foamed medium in which the fibers are entrained. As the agitator 18 travels through the mixture, fibers impacted by the agitator are displaced upwardly or downwardly by the convex leading surface 26.

The convex leading surface of the agitator and the trailing concave following edge are important to the proper function of the apparatus. Fibers are impacted by the leading convex surface. This surface is made to be smooth so that the fibers will slide along this surface without forming multi-fiber aggregates. As the non-cellulosic fibers leave this smooth convex surface they enter the abrupt transition to a concave surface. Intense cavitation occurs at this transition. Air pulled into this zone from the tank vortex or air added to the tank from some other source such as a pipe at the bottom, forms a foam which is stabilized by the presence of a surfactant which has been added to the water. This foam is characterized by small bubble size. Thus the fibers entering this zone of bubble formation are immediately surrounded by foam. Since the foam possesses a high viscosity and low density, the non-cellulosic fibers surrounded by foam are prevented from tangling or flocculating as would be the case if they were in water. This apparatus is unique in its ability to disperse non-cellulosic fiber into a foam uniformly.

The entire mixture of fibers and foamed medium tends to swirl within the agitation chamber 16. It has been found preferably to provide a plurality of baffles 42 projecting radially inwardly from the surface 14 of the agitation chamber 16 in order to deflect the swirling mixture inwardly from the surface 14. This prevents the metal fibers from accumulating at the surface 14 due to centrifugal force. The baffles are preferably plate-shaped and disposed diametrically apart. The number of baffles may vary. It has been found advantageous to provide four baffles when a two-legged agitator (FIG. 1) is used; to provide three or six baffles when a three legged agitator (not shown) is used; to provide four or eight baffles when a four-legged agitator (FIG. 12) is used.

In the case of three baffles, they would preferably be located at the same elevation and spaced apart circumferentially equidistantly.

In the case of four baffles, they would be arranged as two pieces of diametrically opposed baffles. The baffles can be equally circumferentially spaced, or vertically spaced.

The lower pair of baffles could be vertically aligned with respect to the upper pair of baffles, or they could be circumferentially offset therefrom.

Figure 7:
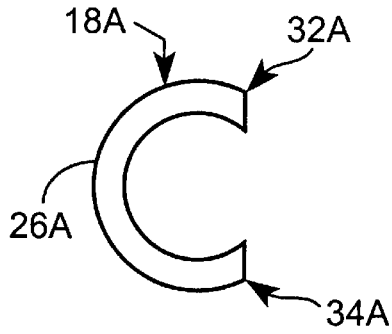

As pointed out earlier, the shape of the agitator legs can assume various forms. For example, as shown in FIG. 7 the agitator 18A could be formed of a segment of a cylinder, as in the case with the earlier described agitator 18. However, the truncation of the cylinder would occur rearwardly of the center of the bar to form the trailing edges 32A, 34A.

Figure 8:
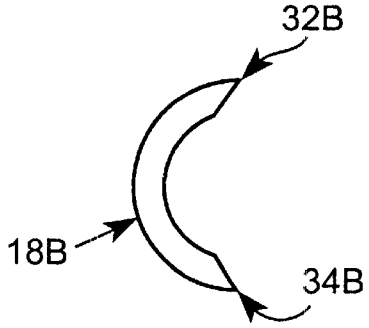

The agitator 18B depicted in FIG. 8 is similar to that of FIG. 6, but the upper and lower trailing ends of the agitator are beveled to form sharper trailing edges 32B, 34B.

Figure 9:
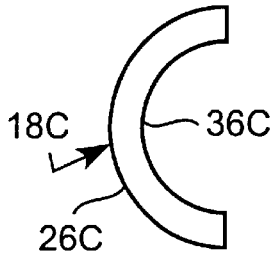

In FIG. 9, an agitator 18C is depicted in which the leading convex surface 26C and the trailing concave surface 36C are of oblong or elliptical shape in cross-section.

Figure 10:
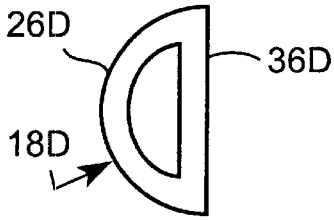

In FIG. 10, an agitator 18D is depicted in which the leading surface 26D is the same as in FIG. 6, but wherein the trailing surface 36D is flat.

An agitator 18E depicted in FIG. 11 has a convex leading surface 26D comprised of two flat portions 50 which converge in the direction of rotation, and which meet at a curved (blunt) junction 52.

The agitation is generally conducted such that the foam furnish created has an air content of at least 50% by volume, and more preferably an air content of at least 75% by volume.

The fibers agitated can comprise any non-cellulosic fiber. The present invention is uniquely applicable to synthetic, e.g., organic, and metal fibers. The fiber mixture can comprise up to 100% synthetic or metal fibers, but the mixture can also comprise cellulosic fibers or other non-cellulosic fibers. It is generally preferred that the mixture contain at least 50% by weight synthetic and/or metal fibers.

While the length of the fibers used can be of any length, the present invention is most uniquely and advantageously applicable to long fibers, i.e., at least one-half inch in length. Fibers of a length of one inch, one and one-half inch or more, even four inches in length, can also be readily incorporated into a non-woven fibrous web using the present agitator and foam process.

As noted above, the present invention is uniquely applicable to the formation of a non-woven fibrous web comprised of metal fibers and/or synthetic fibers. Any synthetic, i.e., polymeric, fiber can be used. Examples include polyester, aramid, polyamide, and polyolefin fibers. Other non-cellulosic fibers can also be used in combination with the metal fibers or synthetic fibers, e.g., such as carbon, inorganic and/or glass fibers. Mixtures of cellulosic (wood) and synthetic or other non-cellulosic fibers can also be used.

The consistency of the foam furnish created, i.e., the percentage solids in the foam furnish, is generally in the range of from 0.2 to 2.0 wt %, and is preferably about 0.5 wt % or greater. A consistency of greater than 0.5 yields a product having a very high basis weight. A consistency of 1.0 wt % or more has heretofore been unusable, and therefore the present invention permits one to operate at much higher consistencies than are conventional, if it is so desired. An important advantage of being able to use such a high consistency is that much less process solution or foam needs to be handled. Inclined wire machines can generally handle 0.5 inch fibers at a consistency of 0.05%, thereby requiring, however, 10×as much process solution or foam. The process of the present invention allows one to handle long refractory fibers at very high consistency, and thereby enjoy the advantages and benefits thereof.

The agitator width to fiber length ratio is preferably at least about 1.25, more preferably at least 1.75, even more preferably at least 2.5 and most preferably at least 3.0. These higher ratios are preferred because they more consistently provide the best formed and most uniform non-woven web products independently of the other variables, such as the RPM of the agitator.

The foamed medium in which the fibers are agitated can be formed during the agitation, or can be formed prior to the agitation of the fibers. When forming the foamed medium in situ, the order of addition of water, chemicals (binder), surfactant and non-cellulosic fiber is not important. The surfactant, water and fiber can be added into the mixing chamber in any order. Once the agitator is started, a successful foam dispersed metal and/or synthetic fiber will result. It is generally preferred, however, to not mix the fibers in the water without the presence of a surfactant. Since no foam would be generated without the surfactant, the non-cellulosic fibers would tend to tangle and agglomerate. It is possible, however, to successfully disperse the non-cellulosic fibers in a pre-existing foam.

The concentration of the surfactant depends on the surfactant. Generally, a concentration of about 0.1 wt % in the solution is preferred for a strong foam forming surfactant. If the surfactant is a weaker foam former, a stronger concentration may be preferred. Anionic, non-ionic and cationic surfactants can all be used, with appropriate adjustments in concentration where needed.

The time the foam furnish is mixed by the agitator of the present invention can vary greatly, as it is only important that a good dispersion of the fiber in the foam is achieved. Once a good dispersion has been achieved, longer mixing or agitation is generally neither helpful or harmful.

The temperature of the foam furnish can also vary greatly. The temperature need only be such so as to allow a foam to be generated.

Other conventional, functional additives can also be added to the foam furnish, as long as they do not interfere with the foaming nature of the surfactant. Polymeric binders can be added, and are preferred. For example, polyvinyl alcohol powder has provided good results, and is a preferred additive. Aluminum sulfate or paper maker's alum can also be added with a compatible surfactant.

Once the foam furnish has been made, the foam furnish is then passed onto a screen, such as that generally used in a typical Foudrinier machine. The foam furnish is then defoamed by using vacuum or suction boxes. Any of the conventional methods and apparatus for forming a fibrous web while using a foam can be employed with the foam furnish of the present invention. The use of the agitation means of the present invention provides a foam furnish with a uniform dispersion of the fibers. As a result, the fibrous web obtained upon defoaming is a web exhibiting good individual fiber separation and a very uniform distribution. As well, there is no directionality of the fibers, i.e., the fiber direction is random, but with a uniform distribution of the fibers.

Such a uniform fibrous web is obtained even when one employs very long fibers, such as fibers having a length of one-half inch, one inch, two inches or longer, and even if cellulosic, synthetic or other non-cellulosic fibers are mixed, even with metal fibers. This is one of the greatest advantages of the present invention in that it permits one to make a fibrous web comprised of long metal and/or synthetic fibers, if desired in combination with other types of fibers, as easily and as quickly as one could make a paper web.

The invention will be further illustrated by the following specific examples. It is to be understood that these examples are given by way of illustration and are not meant to limit the disclosure of the claims to follow.

EXAMPLE 1

Handsheets were made using a 0.75 inch KEVLAR® fiber having a denier of 2.0. The foam forming container was a 20 liter stainless steel tank equipped with four baffles. The tank diameter was 12 inches.

One liter of tap water was used in the formation of a handsheet, with enough of the KEVLAR® fiber being added to give a consistency (weight percent solids in the forming slurry) of about 0.5%.

For each handsheet, the water was added to the tank, then the surface active agent (AOK). Also added to the tank was about 0.5 grams of a polyvinyl alcohol powder available from Celanese under the trademark Celvol 165SF. The consistency, the concentration of the surfactant and the mix time were all held constant for each handsheet.

The agitator was varied in order to study the relationship between the agitator's length, or the diameter of the agitation zone, in relation to the tank's diameter. Therefore, the agitator length, and hence the diameter of the agitation zone, was varied for the different handsheets. The agitator was designed in accordance with the present invention to have a leading surface that was convex with a trailing edge that was concave. The agitator was mounted in a drill press and the RPM was varied for different handsheets made with a particular agitator.

The handsheets were made by turning on the drill press for about one minute to convert the solution containing the water, surface active agent and polyvinyl alcohol powder into a foam. The fiber was then added while the agitator was turning. The mix time was kept to about 3 minutes with the fiber present.

The foam furnish was then poured into a handsheet mold comprised of a screen bottom. The furnish was defoamed with a vacuum assist from a vacuum. The wet handsheet was then placed on a steam heated Teflon® covered drum and dried.

In conventional practice, the foam furnish could be prepared in a similar manner, except on a much larger scale. The foam furnish would then be distributed onto a moving screen from a head box and defoamed using conventional means. The continuous web formed could then be dried using conventional methods such as drying cans. Preferably, the drying cans would be Teflon® coated.

The handsheets prepared were evaluated for both formation and spindle factor. The formation value was a rating between 5 and 1 for the uniformity of the distribution of the solids over the handsheet area. The best formed sheet, having the most uniform distribution, was given a 5 rating. The worst formed sheet was given a rating of 1. The spindle factor rated the number of fiber aggregates which were present. A sheet with all individual fibers (having no fiber aggregates) was given a 5 rating, with a sheet having many spindles and strings (the least desirable sheet) was given a rating of 1.

Nine different agitators were used to make handsheets, with the sheet made with a particular agitator being designated as sheet A–I. Different handsheets for each agitator were made by varying the RPM of the agitator. Each of the sheets were evaluated as described for formation and spindle factor. The results of the evaluations are found in the following table.

TABLE

| Sheet | A | B | C | D | E | F | G | H | I |
|---|---|---|---|---|---|---|---|---|---|
| Tank diameter, inches | 12 | 12 | 12 | 12 | 12 | 12 | 12 | 12 | 12 |
| Diameter d of agitation zone, inches | 8 | 8 | 8 | 8 | 6 | 11 | 6 | 9 | 8 |
| Agitator Width, inch | 0.5 | 1.0 | 1.31 | 1.83 | 1.31 | 1.0 | 1.0 | 1.0 | 2.38 |
| Fiber length, inch | All fiber was 0.75 inch zinc fiber - 1.5 denier | | | | | | | | |
| Diameter of agitation zone/tank diameter | 0.67 | 0.67 | 0.67 | 0.67 | 0.5 | 0.94 | 0.5 | 0.75 | 0.67 |
| Agitator width/fiber length | 0.67 | 1.33 | 1.75 | 2.43 | 1.75 | 1.33 | 1.33 | 1.33 | 3.17 |

| | Formation/Spindle Values | | | | | | | | |
|---|---|---|---|---|---|---|---|---|---|
| RPM | A | B | C | D | E | F | G | H | I |
| 540 | — | — | — | — | — | 3/1 | — | — | — |
| 590 | — | — | — | — | — | 4/2 | — | — | — |
| 650 | 3/1 | 4/1 | 5/2 | 5/2 | 3/1 | 5/3 | 1/1 | 514 | 5/4 |
| 1090 | 5/4 | 5/5 | 5/5 | 5/5 | 3/2 | 4/4 | 3/2 | 5/5 | 5/5 |
| 1280 | 5/4 | 5/4+ | 5/5 | 5/5 | 3/2 | — | 4/3 | 5/5 | 5/5 |
| 1450 | 4/3 | 4+/4 | 4+/5 | 5/4+ | 3/2 | — | 4/3 | 4/5 | 5/5 |
| 1820 | — | 4/3 | 4+/4+ | 4+/4+ | — | — | — | — | 5/5 |
| 2180 | — | — | — | — | — | — | 2/2 | — | — |

Figure 13:
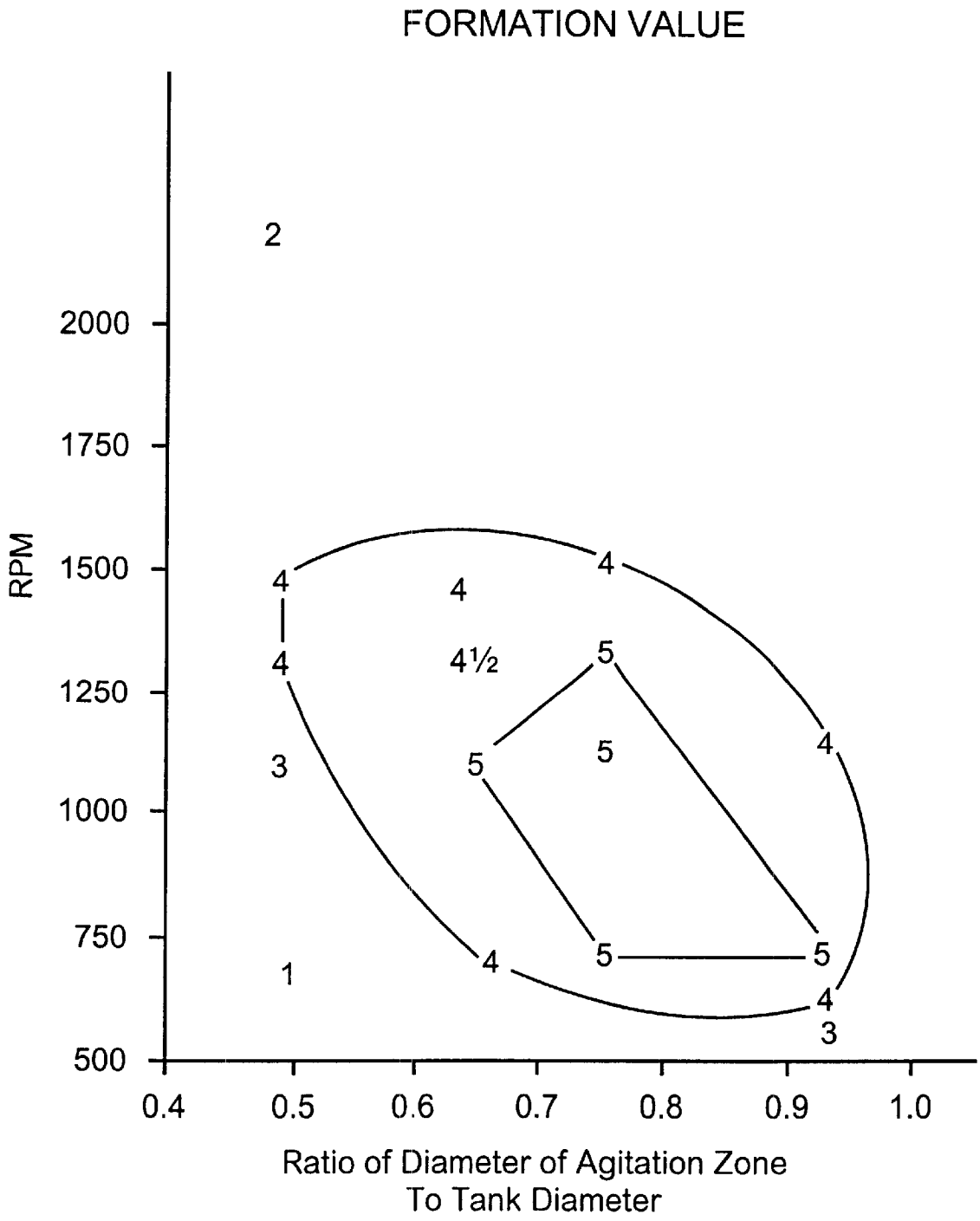
FIGS. 13–16 are graphical representations comparing various parameters of the present invention.
Figure 14:
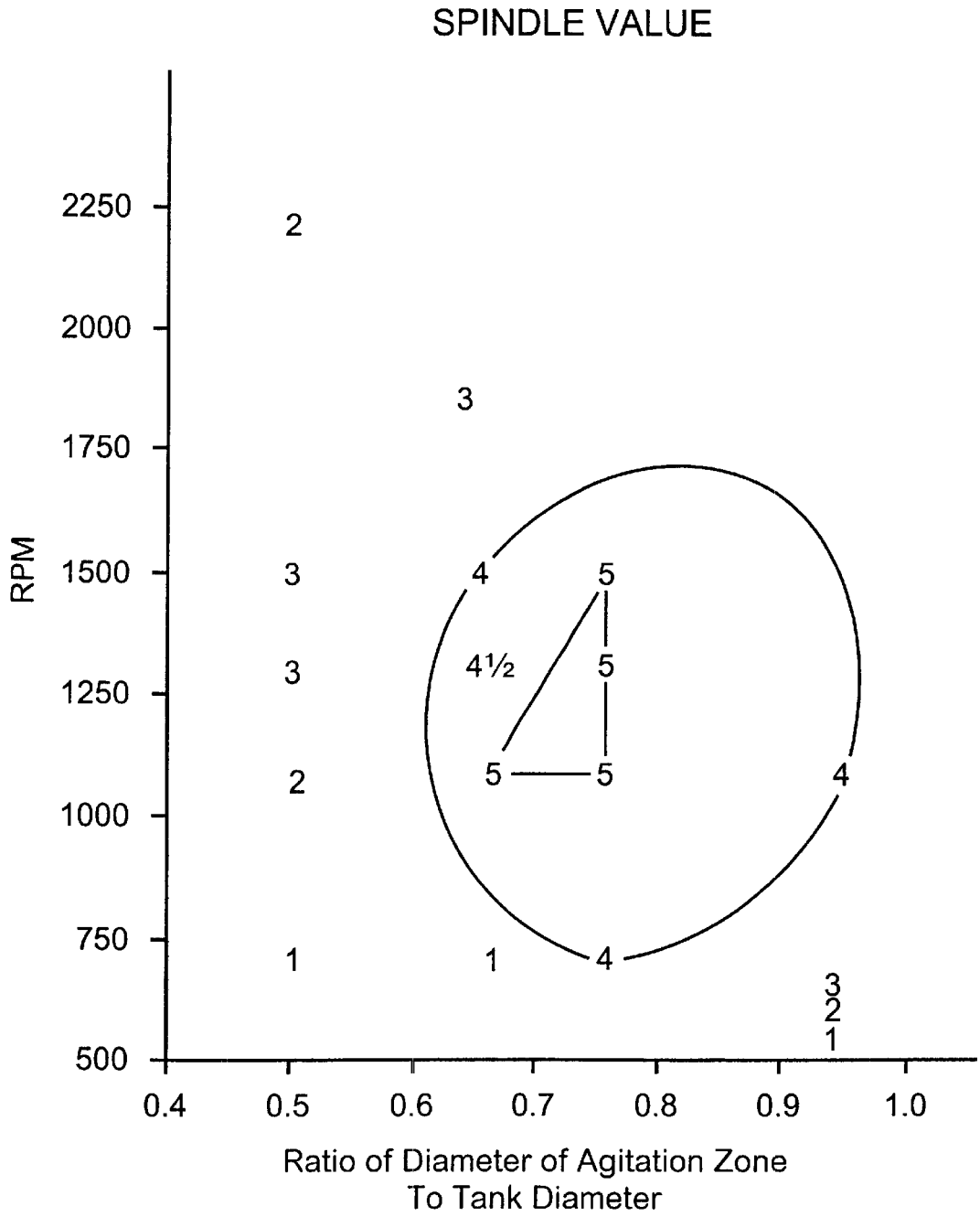
Figure 15:
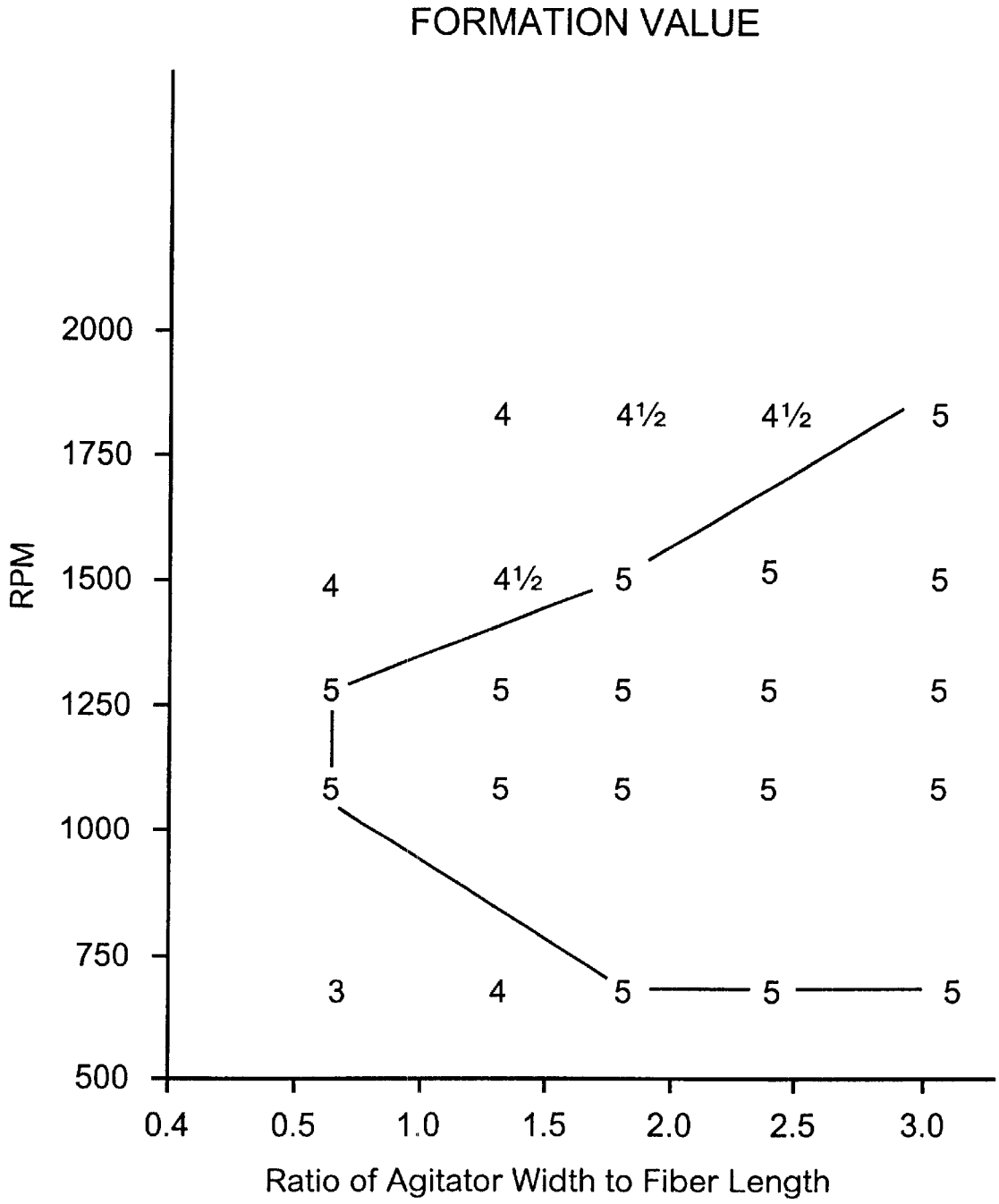
Figure 16:
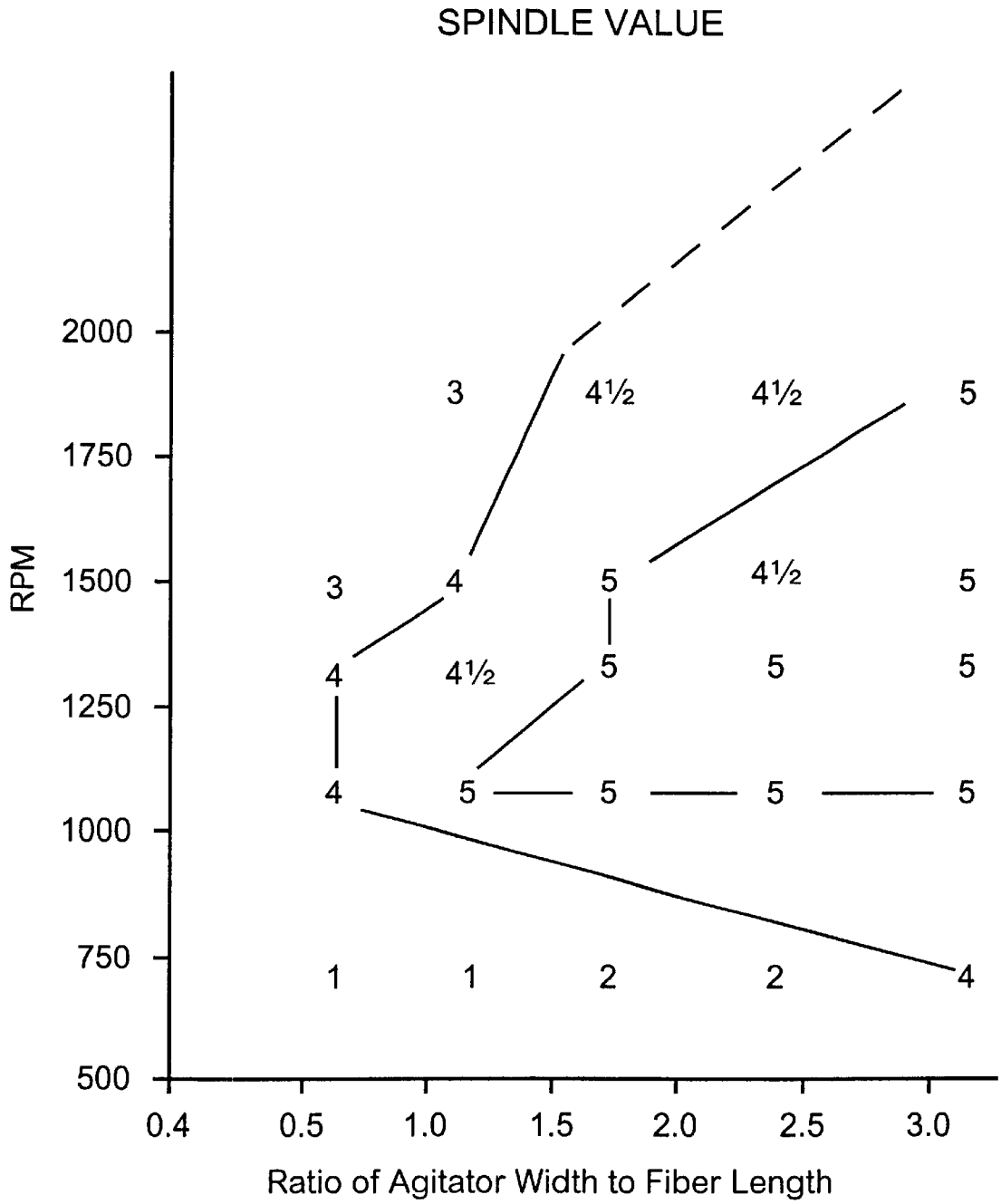

From the foregoing data, it can be seen that excellent fibrous webs having ratings of 4 or 5 for both the formation and spindle factor can be formed when the ratio of the diameter of the agitation zone to the diameter of the agitating chamber or tank throughout the range of from about 0.5 to about 0.95. FIGS. 13 and 14 graphically depict the data. It was also noted that the best conditions for making the metal fibrous webs occurred at high agitator width to KEVLAR® fiber length ratios. It has also been observed that with agitators of greater width, the RPM employed with regard to the agitator is of much lesser importance. FIGS. 15 and 16 graphically depict the data generated in relation to the RPM vs. the ratio of agitator width to metal fiber length.

The RPM employed and the mix time are interrelated in that it is important that the two are combined to secure a dispersion of the KEVLAR® fiber in the foam. Once the dispersion has occurred, however, longer mixing is generally neither helpful or harmful. Of course, the mix time will vary according with the RPM used. When the wider agitator is used, dispersion of the fiber into the foam can generally be obtained for a particular mix time over a wider range of RPM's.

While the foregoing examples demonstrate the present invention and its application to synthetic fibers, the present invention is applicable to all non-cellulosic fibers, including metal fibers as demonstrated by the following runs.

EXAMPLE 2

Six agitators of varying dimensions were used to form stainless steel fiber handsheets with 12 μm×6 mm and 12 μm×12 mm fiber. The six agitations had a length and diameter in inches as follows:

| Agitator | Length | Diameter |
|---|---|---|
| A | 8.25 | 0.5 |
| B | 8.0 | 1.0 |
| C | 8.0 | 1.313 |
| D | 6.0 | 1.313 |
| E | 11.25 | 1.0 |
| F | 8.0 | 1.875 |

The angular velocity of the agitator was varied between 540 and 3000 rpm. The following conditions were kept constant for each run:

Water Volume=2.0 L

Water Temperature=17–21° C.

AOK Mass=2.0 g

Metal Fiber Mass=11.0 g

PVOH Volume=10 mL of 2% Celvol 165SF (Celanese)

Sheets were rated for formation and fiber bundle separation, where a rating of 1 denoted either a poorly formed sheet or a sheet containing largely unseparated bundles. A rating of 5 denotes either a consistently formed sheet or a sheet in which all bundles were separated into individual fibers. Two trials were formed for each set of conditions.

The shorter fiber was much more easily separated and formed into handsheets. For all agitators tested, handsheets with ratings of 4 or 5 for both formation and bundle separation could be formed. A certain minimum rpm was required to achieve this. Generally, an rpm of at least 1090 was needed, but more preferably 1280, and most preferably 1450 to achieve such sheets. Excellent sheets were also observed at rpms of 1820 and 2180, as well as 3000.

The results of the foregoing runs demonstrate the successful use of the agitator and method of the present invention in preparing excellent, uniform non-woven webs of metal fibers.

Having thus described the preferred embodiments of the invention, it is clear that what may appear to be different embodiments could be provided without departing from the spirit and scope of the invention.

What is claimed is:

1. Apparatus for agitating fibers in a foamed medium, comprising:

agitating means mounted for displacement within the foamed medium and including a leading surface facing in a direction of displacement and terminating in upper and lower trailing ends with each defining an edge, the leading surface including upper and lower portions converging in the direction of displacement to form a generally convex leading surface and a concave trailing surface facing away from the direction of displacement such that at each edge defined by the upper and lower trailing ends of the convex leading surface an abrupt transition occurs to the concave trailing surface; and driving means for displacing the agitating means in the direction of displacement for dispersing and mutually separating the fibers within the foamed medium.

2. Apparatus according to claim 1, wherein each edge is beveled.

3. Apparatus according to claim 1, wherein the agitating means is mounted for rotation about an upright axis.

4. Apparatus according to claim 1, wherein the leading surface is continuously curved.

5. Apparatus according to claim 4, wherein the leading surface is shaped as a cylindrical segment.

6. Apparatus according to claim 4, wherein the leading surface is of generally oblong cross-sectional shape.

7. Apparatus according to claim 1, wherein the agitating means is mounted for rotational displacement about a vertical axis.

8. Apparatus according to claim 7, wherein the agitating means includes a plurality generally horizontal legs projecting generally radially from the axis of rotation.

9. Apparatus according to claim 8, wherein the agitating means comprises a bar, two longitudinal end sections of the bar lying on opposite sides of the direction of rotation and defining the legs of the agitating means, a portion of each longitudinal section facing away from the direction of rotational displacement being truncated with respect to the leading surface.

10. Apparatus according to claim 9, wherein the bar comprises a hollow cylinder.

11. Apparatus according to claim 1, wherein the agitating means is mounted for displacement in an agitating chamber of circular cross-section, the agitating means being rotatable about an upright axis coinciding with a longitudinal axis of the agitating chamber, the agitating means forming a central agitation zone, the ratio of the diameter of the agitating zone to the diameter of the agitating chamber being from about 0.5 to about 0.95.

12. Apparatus according to claim 11, wherein the ratio is from about 0.65 to about 0.8.

13. Apparatus according to claim 11, wherein the ratio is from about 0.67 to about 0.75.

14. Apparatus according to claim 1, wherein the agitating chamber is defined by a surface of circular cross-section, the agitating means being mounted for rotation about an upright axis coinciding with a longitudinal axis of the agitating chamber, and a plurality of baffles projecting inwardly from the surface of the agitating tank.

15. Apparatus for agitating fibers in a foamed medium, comprising:

a tank having a cylindrical surface forming an agitating chamber for containing a mixture of fibers and foamed medium;

agitating means mounted for rotation about an upright axis coinciding with a longitudinal axis of the agitating chamber and including a plurality of legs projecting generally radially from the axis, each leg including a leading surface facing in a direction of rotation and terminating in upper and lower trailing ends, with each end defining an edge, said leading surface including upper and lower portions which converge in the direction of rotation to form a generally convex leading surface and a concave trailing surface facing away from the direction of displacement such that at each edge defined by the upper and lower trailing ends of the convex leading surface an abrupt transition occurs to the concave trailing surface; and driving means for rotating the agitating means to disperse and mutually separate the fibers within the foamed medium, the agitating means forming a central agitation zone, the ratio of the diameter of the agitation zone to the diameter of the agitating chamber being from about 0.5 to about 0.95.

16. A method for forming a non-woven fibrous web comprised of non-cellulosic fibers, which comprises:

(i) forming a foam furnish by agitating non-cellulosic fibers in a foamed medium with the apparatus of claim 1, and (ii) passing the foam furnish onto a screen and defoaming the furnish.

17. The method of claim 16, wherein the non-cellulosic fibers agitated are comprised of metal or synthetic fibers.

18. The method of claim 17, wherein the fibers agitated are comprised of cellulosic fibers.

19. The method of claim 17, wherein the weight percent solids of the foam furnish passed onto the wire screen is in the range of from 0.2 to 2.0.

20. The method of claim 19, wherein the weight percent solids of the foam furnish is greater than 0.5.

21. The method of claim 17, wherein the non-cellulosic fibers are comprised of metal fibers.

22. The method of claim 17, wherein the non-cellulosic fibers are comprised of synthetic fibers.

23. A non-woven, fibrous web prepared by the method of claim 17, which web exhibits substantially no fiber directionality.

24. The method of claim 16, wherein the fibers agitated are comprised of fibers at least one-half inch in length.

25. The method of claim 16, wherein the fibers agitated are further comprised of cellulosic fibers.

26. The method of claim 16, wherein the fibers agitated further comprise inorganic fibers.

27. The method of claim 16, wherein the agitation in step (i) creates a foam furnish having an air content of at least 50% by volume.

28. The method of claim 27, wherein the air content of the foam furnish is at least 75% by volume.

29. The method of claim 16, wherein the foamed medium is formed during the agitation of the fibers.

30. The method of claim 16, wherein the foamed medium is formed prior to agitation of the fibers.

31. The method of claim 16, wherein the ratio of agitator width to fiber length is at least 1.25.

32. The method of claim 16, wherein the ratio of agitator width to fiber length is at least 1.75.

33. The method of claim 16 wherein the ratio of agitator width to fiber length is at least 3.0.

34. A non-woven, fibrous web prepared by the method of claim 16, which web exhibits substantially no fiber directionality.

* * * * *